United States Patent [19]

Jorgensen et al.

[11] Patent Number: 4,798,350

[45] Date of Patent: Jan. 17, 1989

[54] WEB REWIND APPARATUS WITH CUTLESS WEB TRANSFER

[75] Inventors: Allen R. Jorgensen, Abrams; Larry P. Belongia, Oconto; Kenneth A. Gordon, Sobieski; John L. La Haye, Green Bay, all of Wis.

[73] Assignee: Magna-Graphics Corporation, Oconto Falls, Wis.

[21] Appl. No.: 55,697

[22] Filed: May 29, 1987

[51] Int. Cl.[4] ..... B65H 18/08

[52] U.S. Cl. ..... 242/64; 242/65; 242/67.1 R

[58] Field of Search ..... 242/55, 56 R, 56 A, 242/67.1 R, 65, 66, 64

[56] References Cited

U.S. PATENT DOCUMENTS

| | | | |
|---|---|---|---|
| 2,920,836 | 1/1980 | DeBell | 242/65 |
| 3,148,843 | 9/1964 | Turner et al. | 242/56 R |
| 3,383,062 | 5/1968 | Meihofer et al. | 242/56 A |
| 3,471,097 | 10/1969 | Phelps | 242/56 R |
| 3,603,522 | 9/1971 | Herrmann | 242/56 R |
| 3,744,730 | 7/1973 | Burnage | 242/56 A |
| 3,765,615 | 10/1973 | Brink et al. | 242/56 R |
| 3,871,595 | 3/1975 | Smolderen | 242/56 A |
| 4,033,521 | 7/1977 | Dee | 242/56 A |
| 4,146,187 | 3/1979 | Steiner et al. | 242/65 X |
| 4,171,780 | 10/1979 | Bugnone | 242/56 A |
| 4,345,722 | 8/1982 | Kuhn | 242/56 R |
| 4,422,586 | 12/1983 | Tetro | 242/56 R |
| 4,431,140 | 2/1984 | Tetro | 242/56 A |
| 4,445,646 | 5/1984 | Karr et al. | 242/56 R |
| 4,485,980 | 12/1984 | Gorner | 242/56 R |
| 4,489,900 | 12/1984 | Morizzo | 242/56 R |
| 4,529,141 | 7/1985 | McClenathan | 242/56 A |
| 4,546,930 | 10/1985 | Konishi et al. | 242/56 R |

*Primary Examiner*—David Werner

*Attorney, Agent, or Firm*—Andrus, Sceales, Starke & Sawall

[57] ABSTRACT

A paper web rewind device includes a rewind turret having circumferentially spaced support members with end chucks for rotatably supporting tubular cores on which a web is rewound. Each set of supports is separately rotated and the turret is rotated to locate one core at a rewind station and the second core at an unload/-load station. A rider roll at the rewind station is pivotally mounted and moves upwardly onto the core and then outwardly as the roll diameter increases. Just prior to completion of a rewound roll, the turret rotates and moves the rewinding roll while continuing to wind web thereon and also moves a new core to the loading station with rider roll moved to engage the new core. The moving web engages the new core which is rotated at winding speed. A sensor senses the turret position and is operable to decrease the winding speed of the wound roll to create a slack loop between the new core and the wound roll. The high speed rotating new core attracts the slack web onto the new core and the web wraps onto the new core and into the nip between the new core and rider roll. The rotation of the wound roll is stopped and the rotating new roll pulls on the slack loop and creates a sudden snap action force on the web. The snap action force separates the web immediately adjacent the rider roll on a line extending across the web and thereby frees the web for a continuous winding onto the new core.

12 Claims, 3 Drawing Sheets

WEB REWIND APPARATUS WITH CUTLESS WEB TRANSFER

BACKGROUND OF THE PRESENT INVENTION

This invention relates to a web rewind apparatus having a cutless web transfer unit and particularly having a cutless web transfer unit for separating of a web from a rewinding roll and transferring of the separated web onto a new rotating rewinding core.

Web material is formed in relatively large rolls for subsequent processing and converting. The web may be a paper, film or other thin flexible material which is manufactured as a continuous web wound onto a suitable supporting roll form. Various converting and processing machines are constructed with an unwind stage for receiving of the web roll. The web is threaded and passes through the converting machine which has one or more work stations for treating and processing of the web as it moves therethrough. The integrity of the web is often maintained and rewound at a rewind station for subsequent handling. The rewound roll may be of a similar or different size from that of the original roll. Further, the system is normally established to permit a continuous run by the automated insertion of a supply roll at the unwind station and automatic interconnection and splicing to the existing roll, in combination with a similar automatic transfer from a fully rewound roll to a new rewinding core unit. The automated roll interchange and splicing at the unwind stand is well known. Similarly, the automatic transfer of the processed web in the rewind stand and the transfer of a full roll to a new rewinding core unit is also well known.

Generally, the rewind stand in commercial apparatus includes a turret mechanism for automated movement of a full rewound roll unit to a load/unload station, with the simultaneous movement of a new roll unit to a rewind station. In an adhesiveless transfer, a knife cut-off and special web transfer mechanism is provided at the rewind station for cutting of the web at that location and transferring of the cut web onto the new roll unit. The tail end of the web on the fully wound roll is wound onto such roll to form a final rewound roll at the load/unload station. The severing of the web and the transfer onto the new core unit has presented a continuing design consideration particularly with the increasing linear web speeds in web processing or converting machines. For example, current converting machines having a specification of 2,500 feet per minute or more is considered a highly desirable feature in the paper converting art.

Both coreless and core rewinding apparatus is used. In one typical core rewind apparatus, a turret is provided having core supporting arms projecting diametrically through the axis of rotation. The axially extended arms terminate in axially aligned chucks for releasably engaging the opposite ends of an elongated tubular core. Individual drive motors are coupled to each of the core supports and generally are mounted to provide direct drive of the core spindles. In addition, a separate turret drive provides for controlled and selective rotation of the turret between 180° horizontal orientations. The load/unload station is located to one side of the turret and one set of the core spindle assembly is located at the load/unload station. The rewind station is located to the diametrically opposite side of the turret and the opposite core spindle assembly is located at the web transfer rewind station. The free end of the web is wound on the core at the rewind station. After a couple of turns, the free end of the web is captured to the core and the rotation of the core continues to pull the web onto the core to rewind the web into a new rewound roll. Conventionally, a rider roll is mounted at the rewind station to established a pressurized interengagement of the web onto the roll or the core and also to iron out air entrapped between the wound layers of the web. A tension control means is also incorporated into the drive system to maintain a predetermined web tension on the web as it rewound onto the roll. When the roll has reached a desired diameter, the rider roll is removed from its operative position. The turret is then rotated with a continuing rewind of the web onto the essentially filled rewound roll. A guide roll is provided in the turret mechanism to raise the web and permit continuous movement onto the roll as the turret rotates. Simultaneously, the new core assembly or unit, which was inserted at the load/unload station, rotates into the position for winding of the web onto the new core. The transfer unit generally includes an enlongated knife extending across the web. The knife is movably mounted to the outside face of the web which moves and slightly downstream of the core location in the rewind station. The knife is adapted to move downwardly onto the moving web between the new core in the rewind station and the essentially fully wound roll at the unload station. The knife thus functions to define a tail end of the web on the rewound roll and a free unsupported end of the web to be transferred onto the new core at the rewind station. The movement of the tail end has not presented a significant problem. The transfer of the free, unsupported end of the web onto the new core has required special and relatively complex equipment. Generally, in adhesiveless transfers in addition to the knife, various air directing and guide mechanisms have been provided for capture of the free web end and directing it onto the core to initiate a couple of wraps after which the rotation of the core insures the firm grip on the free end of the web for continuous rewinding and initiation of a new rewound roll. For example, various suggestions have provided various forms of air transfer with air blasts applied to the outer side of the web immediately adjacent to the knife to force the web onto the core at least during the initial wraps. In addition, various guide and shields are provided to guide the web directly or in combination with the air transfer to maintain the web onto the roll core during the initial rotations and wrapping of the free end of the web onto the core. The above system particularly describes an adhesiveless transfer. Adhesive transfers are also used in the art wherein an adhesive or tape medium is applied to the core to receive and capture the free end of the web.

Reference may be made to the following prior art patents which disclose various knife and associated devices for cutting and transfer of the web:

| Patent No. | Issue Date |
|---|---|
| 3,148,843 | 09-15-1964 |
| 3,744,730 | 07-10-1973 |
| 3,765,615 | 10-16-1973 |
| 3,871,595 | 03-18-1975 |
| 4,033,521 | 07-05-1977 |
| 4,345,722 | 08-24-1982 |
| 4,422,586 | 12-27-1983 |
| 4,431,140 | 02-14-1984 |
| 4,445,646 | 05-01-1984 |
| 4,515,321 | 05-07-1985 |

-continued

| Patent No. | Issue Date |
|---|---|
| 4,529,141 | 07-16-1985 |
| 4,546,930 | 10-15-1985 |
| 4,489,900 | 12-25-1984 |

Although such systems are relatively widely used, the inventor has found that prior art systems are complex, expensive and subject to less than optimum repeatable operation. Further, the mechanisms are particularly troublesome when attempting to effect a transfer at and above web speeds of 2,500 feet per minute. Although knife mechanisms can be provided to provide the relatively instaneous severing, the subsequent movement of the free end of the web onto the core in a reliable and repeatable manner has not been found to be established by commercially available mechanisms or the mechanisms suggested in the prior art. The knife must generally sever the web at a rate faster than the web speed and even though the knife may provide proper severing, the mechanical mechanisms and the air flows created with air transfer and similar systems, particularly at high speed, cannot provide a totally repetitive sequence such as to insure a similar transfer of a free web end onto the core with a reliable multiple initial wraps to secure the web to the core. Thus the free end of the web is subject to various conditions which tend to vary the movement somewhat. In addition, the air flow and its interaction with the mechanical mechanism may well constitute a source of variation in web transfer, resulting in unsuitable and unexceptable transfer.

In addition, the combination of the knife, the air mechanism and the various shields and guides add significantly to the initial cost of the rewind apparatus. Such complex mechanisms also must of course be periodically serviced and maintained, further contributing to the total operating cost of the paper converting machinery.

In summary, the prior art with its various suggestions provides at best a less than satisfactory web transfer mechanism for use with rewind apparatus and add an undesirable initial and subsequent operating cost, particularly as the web speed increases. There is therefore a need for an inproved reliable transfer mechanism which will provide an effective, reliable and repeatable transfer and preferably at a lesser initial and subsequent operational cost.

SUMMARY OF THE PRESENT INVENTION

The present invention is particularly directed to a highly simplified and improved rewind apparatus having a cutless web transfer mechanism and one which essentially eliminates the knife, as well as the necessity of assist devices such as fluid transfer assists and guide assist essentially universally suggested in modern transfer technology. Generally in accordance with the teaching of the present invention, the rewind apparatus is provide with a suitable mechanism for simultaneously moving of a rewound rotating core unit from the unwind station and moving of a new core unit into a rewind station or position with the web spanning the new core and the partially filled rewound roll. A rider means is provided for selective movement into engagement with the new core means. With the rider means located to engage the new core to the side opposite from that over which the web is passing to the partially wound roll. During the transfer, the web moves over the new core which is rotated at a high speed, such as the rewinding speed in accordance with the linear speed of the web. At the desired transfer, a slack loop is formed between the wound roll and the new core. The slack loop has one leg adjacent the new core which is wrapped about the rotating core and moves into the nip between the core and the rider means. The inventor has further discovered that the reverse curved connecting portion is actually drawn into and firmly grasped by the nip between the rider means and the core with the web slightly encircling and wound onto the core. Further, a differential speed introduced between the new core unit and the rewound roll unit is such that there is a snap action on the slack loop which results in a separation of the web along a substantially transverse line of the web producing an automatic cutless transfer of the web, and producing a free end which is reliably and repeatably applied and transferred to the new core unit. The result is an inexpensive transfer apparatus and method with an exceptionally high degree of reliability and repeatability. Although the severed line may not be as smooth as a severing created by a knife mechanism, the separation is completely acceptable. Further, the snap-action separation is found to operate most satisfactorily with the high speeds web processing and particularly performs completely satisfactory with the web moving at and above 2,500 feet per minute.

More particularly in a preferred construction, the apparatus incorporates a turret mechanism having diametrically a plurality of circumferently spaced core spindle support units. Each spindle unit includes its own independent drive operable to rapidly accelerate the empty core means to match speeds as well as operable to rotate the core means for tension rewind of the web onto the core means. The turret is provided with its separate rotating indexing drive for orientation of the turret and particularly the support units between a load/unload station and a rewind station. The web is fed from the converter or unwind station over suitable guide and tension control mechanisms unto the core means at the rewind station. A rider roll is provided to the side opposite the infeed side of the web onto the core unit and the roll. The rider roll is adapted to be moved from the rewound roll during the cycle time of transfer to permit the indexing and transfer of the new core unit into the rewind station. During transfer, the turret is rotated to carry the rewound roll from the rewind station, with the continuing rewind of the web onto the rewound roll to finish such rewinding. During the rotation and indexing of the turret, the new core unit is accelerated up to match speed and is perferably at or above the desired rewind speed at the time the new core unit enters into the rewind location or station. The rider roll is brought up into engagement, simultaneously or subsequent to the location at the rewind station. At that time, a signal is generated to reduce the relative speed of the rewound roll. The relative high speed new core unit however creates a slack loop moving downwardly along the new core unit and between the new core unit and the partly wound roll. The reverse or base portion of the loop moves into the nip between the new core unit and the rider roll to grip the web and initiate the separation and transfer. Simultaneously therewith in the optimum construction, the rewound roll is dynamically braked to effect a rapid reduction in forward winding rotation and thereby producing the snap action force on the slack loop and creating a highly effective, even and reliable separation of the web at the rewind station and particularly at the new core unit. This results in a relatively short double folded or wrap portion onto the new core unit with greater portion of the slack loop appearing as the tail on the wound roll. The new core unit is driven in the tension mode to provide for the establishment of a new rewinding and forming of a new rewound roll. The system can be provided with a suitable programmed controller, or any other form of a control system, to monitor the position of the elements and provide for the automatic transfer of the web from the essentially fully wound roll to a new core unit. This system can of course also provide for automatic sequential transfer in response to a monitored state of the turret rewind apparatus or other suitable support as well as provide for a semi-automatic response controlled by the operator.

In summary, the present invention provides a simple, reliable and and inexpensive web transfer apparatus for web rewind systems and particularly adapted to high speed web processing apparatus, including operating at linear web speeds of 2,500 feet per minute and above.

BRIEF DESCRIPTION OF DRAWINGS

The drawings illustrate the best mode presently contemplated of carrying out the invention.

In the drawings.

DESCRIPTION OF ILLUSTRATED DRAWINGS

Figure 1:
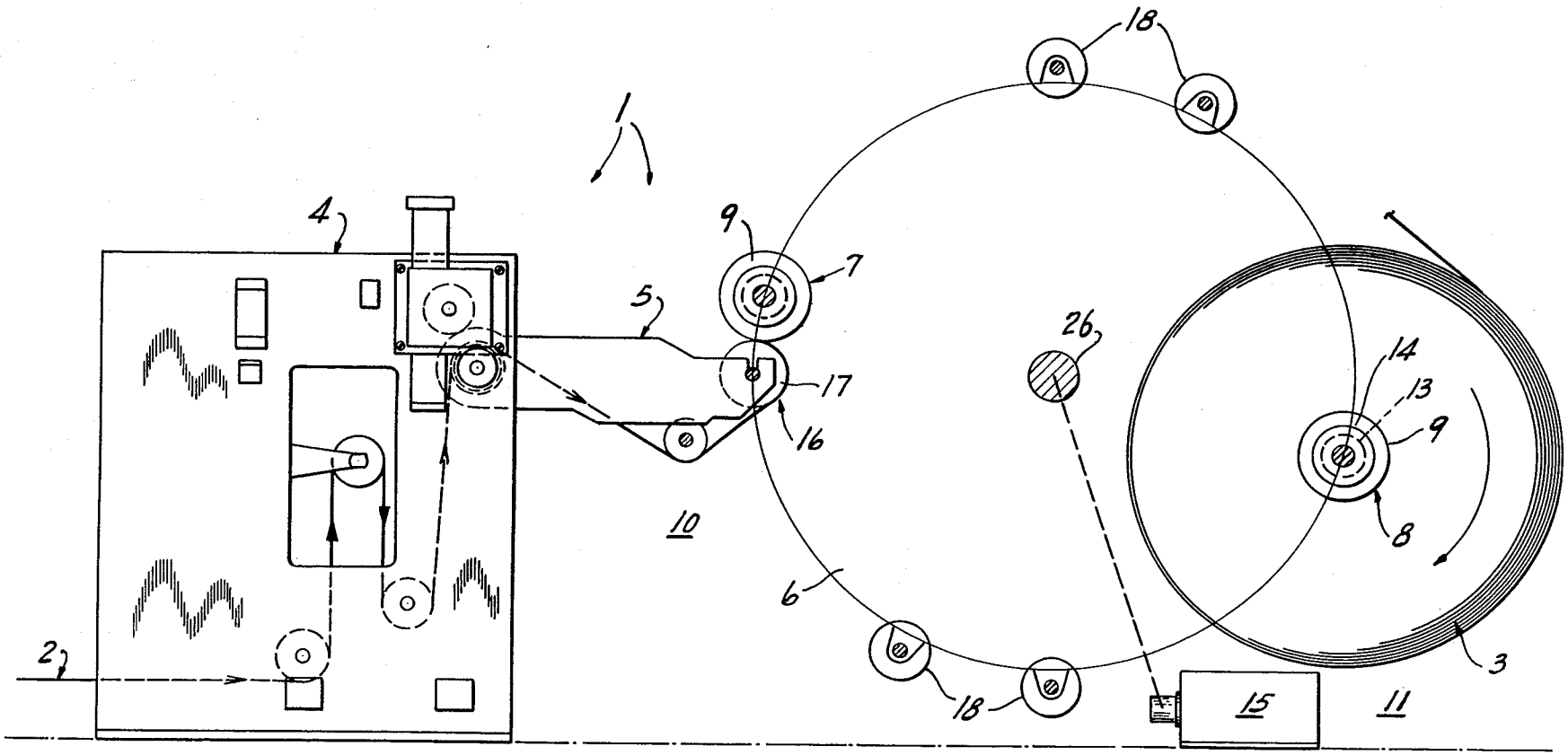
FIG. 1 is a side elevational view of a turret rewind apparatus incorporating an automatic web transfer unit apparatus constructed in accordance with the teaching of the present invention.
Figure 2:
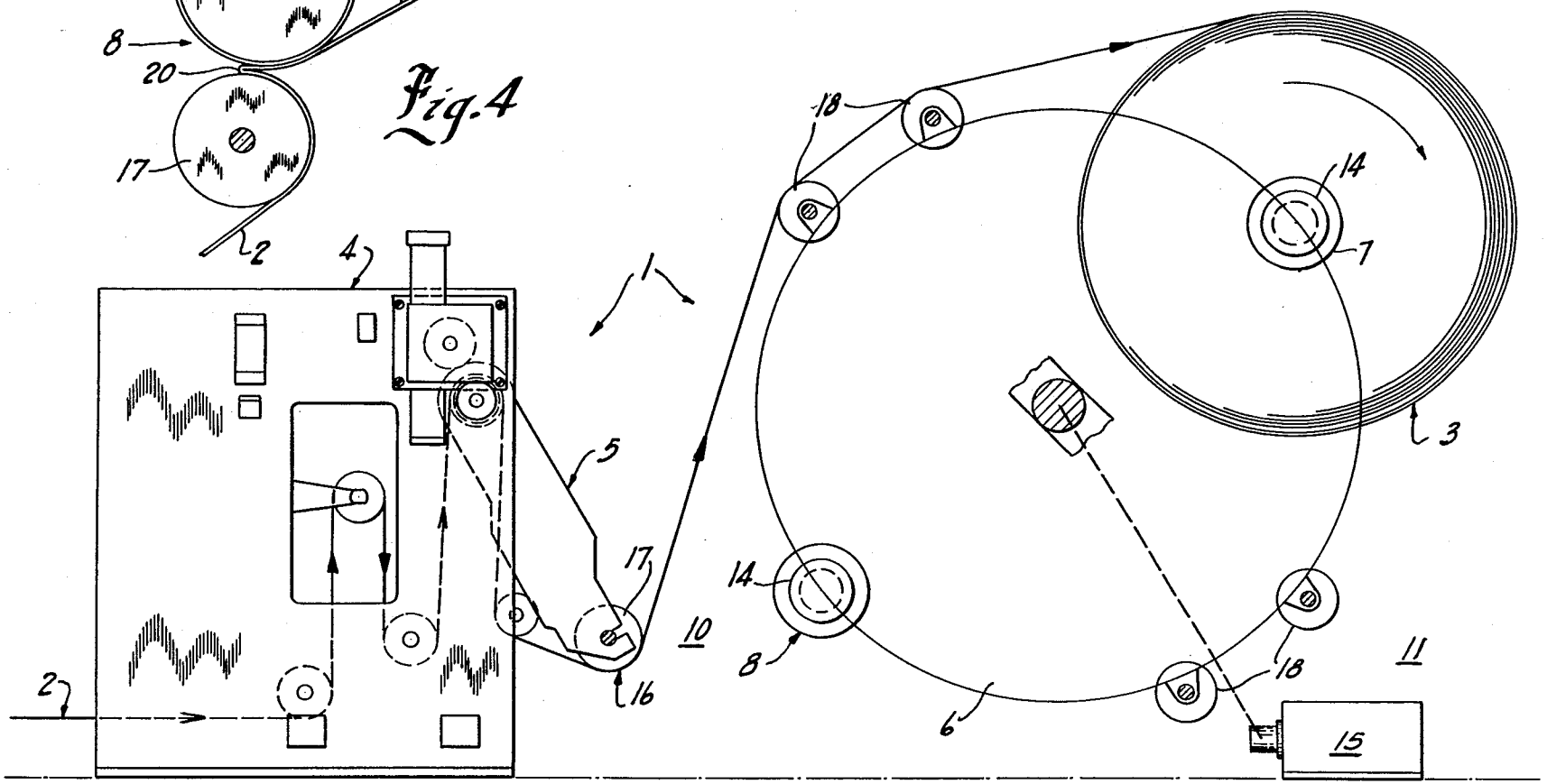
FIG. 2 is a view similar to FIG. 1 illustrating the movement of the illustrated turret to initiate a transfer.

Referring to the drawings and particularly to FIGS. 1 and 2, a rewind apparatus 1 is illustrated for rewinding of an incoming web 2 from a web processing or converting machine, not shown. The web 2 is typically a coated or uncoated paper, film or other continuous web material. For example, typical paper to which the invention has been applied includes carbonless paper of 10 pounds per 1300 square foot ream and release lines of 40 pounds to 100 pounds per 3000 square foot ream. The web 2 is threaded through the converting machine, not shown, where the web is worked and processed and then fed to the rewind apparatus 1 and wound into a rewound roll 3. The rewind apparatus 1 includes web tension and supply unit 4 with a pivoted guide arm 5 for feeding and guiding the web 2 to a turret unit 6. In the illustrated embodiment, a pair of rewind core units 7 and 8 are rotatably carried on diametrically opposite sides of a rotational axis of the turret unit 6. Of course any number of circumferentially spaced core units could be provided, with sequential movement between one or more unload/load stations, and even one or more rewind stations. Each of the rewind core units 7 and 8 is identically constructed to releasably support an elongated tubular core 9 respectfully. The turret unit 6 supports the core units 7 and 8 in alternate positions generally in a substantially horizontal plane. The core unit 7 in the illustrated embodiment is shown located in an rewind stand or location or station 10 adjacent the outfeed side of the apparatus 1 at which web 2 is being wound onto the core 9 as the result of the rotation of the core 9. The second core unit 8 is located on the turret spaced approximately one hundred and eighty degrees from unit 7, and is located at a load/unload station 11 for removing of a fully rewound roll 3 and replacing thereof with a new unwound core 9.

Each of the core units 7 and 8 includes spaced spindles 13, with an independent core drive motor 14 coupled to drive the one spindle and rotate the coupled core 9. The spindles 13 releasably engage the opposite ends of core 9 to support and rotate the core.

At the rewind stand 10, the rotation of the core 9 operates to wind the web 2 onto the core 9. A turret drive motor 15 is coupled to the turrent unit 6, as diagrammatically illustrated, to rotate the turret unit and thereby core units 7 and 8 between the rewind location or station 10 and the load/unload station 11 for formation of the rewound roll 3 on the core 9 at the rewind location. The illustrated structure is a glueless type of a core winding system, and the free end of the web 2 must be wrapped onto the core 9 for at least a couple of turns to capture the web onto the core after which the rotation of the core insures continuous winding of the web onto itself to form the rewound roll 12. A rider roll unit 16 is provided as presently discribed to contribute to the reliable winding of the web onto the core.

Web 2 is shown passing from feed unit 4 and arm 5 over the core 9 of core unit 7 at the rewind station 10. The arm 5 is pivotally mounted and has a rider roll unit 16 on the outer end. The roller unit 16 is located to the underside of the core unit 7 in the rewind position at the rewind station 10 in the illustrated embodiment. The unit 16 includes a freely rotating rider roll 17 which is selectively moved into engagement with the core 9 and web 2 for holding of the web onto the core during forming of roll 12 to provide a continuous smooth wrapping of the web 2 into the roll 3.

After formation of the roll 3 and just prior to the completion of the formation of the roll, the turret unit 6 is rotated and indexed to carry the partially wound roll 3 toward the unload station 11 with the web 2 still attached to and being wound onto the roll 3, as shown in FIG. 2. The roll 3 may require a predetermined number of wraps or layers, and the rewind apparatus may include a rotational counter to count the number of revolutions of the core unit or sense the diameter of the roll 3. A pair of free-wheeling guide rolls 18 are secured to the turret between the core unit 7 and 8. The rolls lift the web 2 upwardly from the rewind location or station 10 to free the rewind location to receive new core unit 8 with the fresh or new core 9, at which time the apparatus is essentially in the position shown in FIG. 3.

Figure 4:
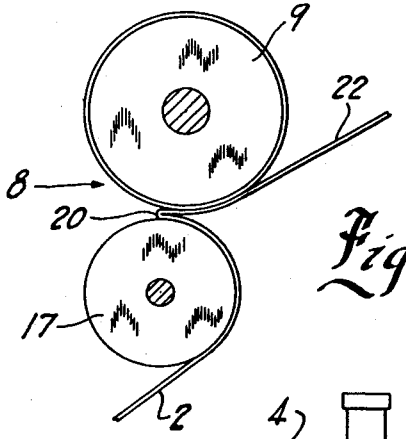
FIG. 4 is a fragmentary view essentially at the point of effected transfer.
Figure 3:
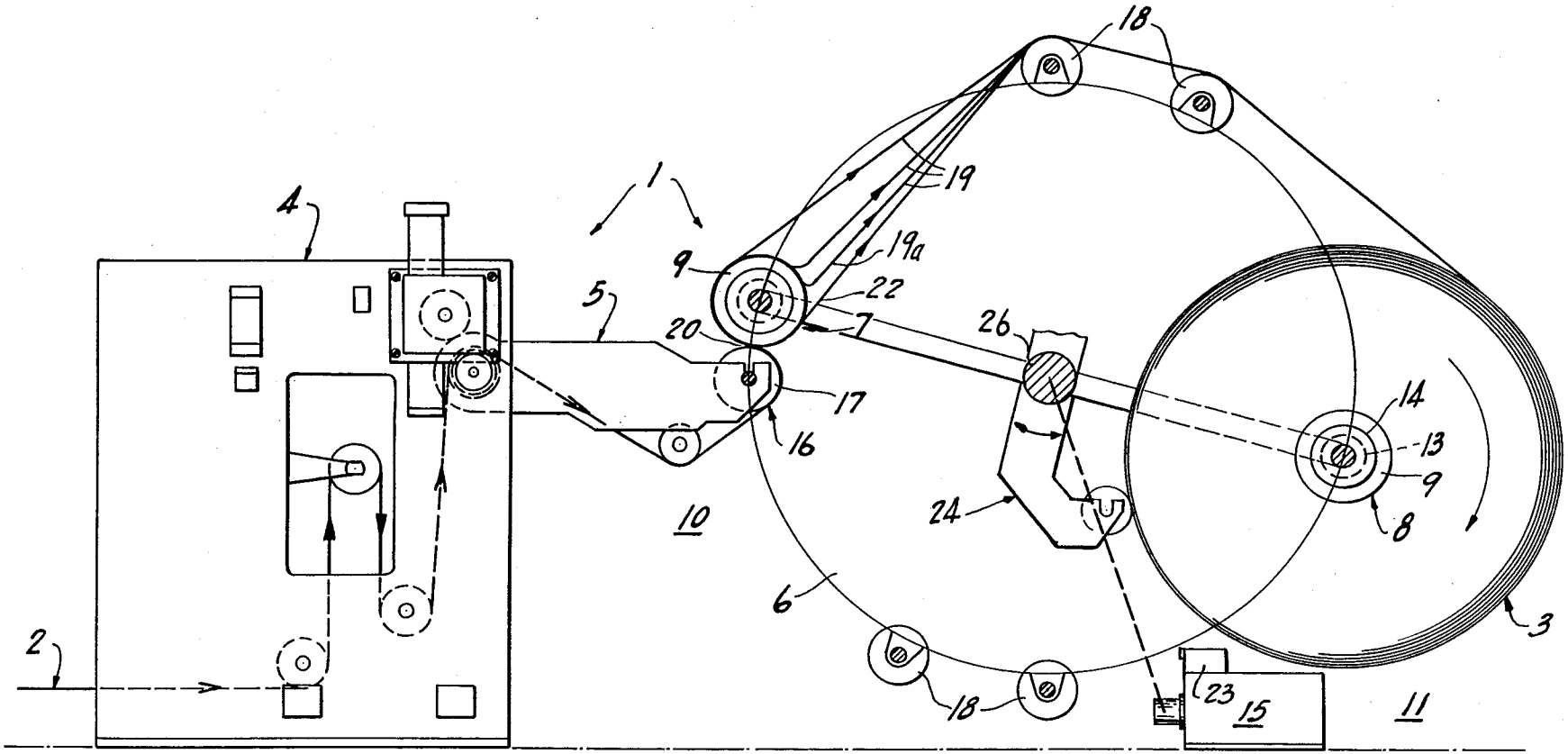
FIG. 3 is a view similar to FIG. 2 illustrating the turret and transfer mechanism during a transfer cycle.

As the turret indexes from the winding position of FIG. 1 to the transfer position of FIG. 3, the arm unit 5 is located from the winding position to allow entrance of the new core unit 8, as shown in FIG. 2. Generally at that time, the full roll drive speed for unit 7 is actuated such that the winding rate and speed is reduced while the new roll core 9 speed is established at a desired line speed to create a differential speed. The result is the formation of a slack loop 19 between the new core unit 8 at the rewind station 10 and the rewound roll 3 at the load/unload station 11. The slack loop 19, as more fully developed hereinafter, maintains engagement with the new core 9 and the reverse curvature portion 19*a* is rapidly drawn around and into and between the nip 20 of the rider roll 17 and the core 9. The double fold of the web 2, and particularly of the slack loop 19*a* as most clearly shown in FIG. 4, at the nip 20 is firmly grasped under pressure conditions established by the rider roll 17. The new core 9 pulls on the incoming web 2 and simultaneously the rewound roll 3 pulls backwardly on the slack portion of loop 19. This results in a rapid snap action force applied to the tail end portion from the fully wound roll and has been found to effect a complete separation along a substantially transverse line 22 as shown in FIGS. 3 and 4. The web 2 may be a standard paper stock such as widely used for coated paper and the like, or any other suitable film-like material. The illustration of FIG. 4 shows the web with a substantial thickness for purpose of clarity, whereas it will be readily understood that the material is generally a thin flexible paper, plastic or the like. The snap action force can be amplified by providing a braking force on the rewound roll 3 essentially at the time of transfer. Thus, a sensor unit 23 may be located to sense the position of the turret, or to respond to the output of the roll size monitor or sensor, not shown, to apply a dynamic or other braking force on the wound roll 3. An internal or inside rider roll 24 may also be provided to engage the finished or completed roll 3 during the indexing and final winding of the web, including the tail portion. The insider rider roll 24 serves to iron out air which might be trapped between the web layers and also maintains control of the web during the indexing. The snap-action transfer system has been applied to a rewind apparatus, and operated continuously in a repeatable manner in such web processing apparatus operating with linear web speeds of 2,500 feet per minute.

The interaction of the new core and the web is such as to continuously maintain rapid movement of the web past the new core. The result is a formation of a slack loop in the web between the new core and the idler roll. It would appear that the rotation of the new core creates an air flow on the core surface which causes the web to move onto the new core.

In a preferred illustrated embodiment of the invention, the turret unit 6 is formed of a generally known construction. In the illustrated embodiment of the invention, the illustrated core units 7 and 8 are formed at the opposite ends of a relatively rigid support arms 25 mounted on a rotating turret shaft 26. The arms 25 may be mounted for axial positioning on the shaft for accomodating various web widths and roll lengths. The positioning of the arms can also be used during a winding cycleto maintain the proper web alignment.

The core units 9 at the opposite outer ends of the arms are similarly constructed, with chuck and spindle units 13 secured to the ends of the arms and defining an axis of rotation parallel to the turret axis. At least one of the chuck and spindle units 13 is movable axially to permit insertion of the hollow core. The drive motor 14 is secured to the spindle unit 13 for rotating the spindle and the interconnected core 9. A suitable clutch and brake unit, not shown, may be coupled to the motor and the spindle unit, or the motor may be provided with a dynamic braking circuit, for controlling rotation of the core.

The turret shaft may be coupled to a large "bull" wheel as diagrammatically shown which is driven from the drive motor 15 to provide for smooth controlled turning of the unbalanced turret with the full roll on one side and the empty core to the opposite side. The "bull" wheel is coupled by a suitable drive coupling, such as a belt or gear drive to the drive motor 15 for selective and controlled rotation of the turret for repositioning of the core units 7 and 8 between the rewind location or stand and the load/unload location or station whereby the web is wound onto the core by rotation of said core.

Commercial implementation of the present invention has shown a highly operative movement of the slack loop onto the core. The rotating core draws the slack loop of the web into the nip between the core and the raised positioned on the rider roll. As the web moves into the nip, the web is firmly grasped and moved through in the nip. This movement of the paper laterally between the nip results in a rapid drawing of the paper web from the direction of the rewind movement of the web into the wound roll with a rapid tightening of the paper web between the nip and the rewound roll. By appropriate manipulation of the rewound roll, the removal of the slack in the loop between the nip and the rewound roll is established very rapidly, and creates a snap action force on the web. The snap action force is sufficient to break the paper web on a transverse line roughly approximately a lateral line. The actual break line may have various offset portions and be in the form of a more or less ragged break. However, the break is such that only a relatively small reverse length or lead of web, such as typically illustrated in FIGS. 3 and 4 is created on the core and then only immediately adjacent to the nip of the rider roll and the core.

For optimum operation, the inventors have found that the snap action severing immediately adjacent to the rider roll is promoted by essentially instantaneously braking of the rewound roll momentarily at the moment of the desired programmed transfer. The rapid rotating core then excerts a strong pulling force on the web and the snap action is created closely adjacent to the core thereby minimizing the double lap lead applied to the first turn of the new core. The continuous winding of the core results in wrapping of the separated end tail of the web onto the new core to initiate the new roll.

The present invention has been illustrated in a simplified illustration of a rewind turret having a pair of core supports for rewinding of an integral web member of a thin film material. The invention is of course applicable in any rewind apparatus having spaced stations for loading/unloading and for rewinding. Thus, the web may be a slit web defining a plurality of side-by-side web sections. Further, the transfer of the web may be any desired location about the core by appropriate positioning the ride roll unit or other appropriate clamping or gripping unit for proper operation at the time of transfer. For example, the rider roll might be provided to the top of the core unit with the infeed of the web to the lower end of the core unit. A suitable lift device would be coupled to the web between the rewind means at the rewind location and the rewind means receiving the web to move the slack loop onto the new core unit in the rewind location. A suitable lift device for example would be a fluid system such as air, preferably extended across and the outer side of the web. This and other modifications may be made within the scope of the present invention which is directed to a winding apparatus having a transfer system and method incorporating a means to form a slack loop in combination with means to create a snap action on the web to separate the web. For optimum operation, the web is held to the newly presented web receiving rewind unit to establish a reliable and repeatable severing closely adjacent the receiving rewind unit.

Various modes of carrying out the invention are contemplated as being within the scope of the following claims particularly pointing out and distinctly claiming the subject matter which is regarded as the invention.

We claim:

1. The method of rewinding a web passing through a web processing machine, comprising mounting a rotating core adjacent the discharge end of the machine with the free end of the web applied to said core to affix the web to the core whereby rotation of the core results in winding of the web onto the core as a continuously enlarging roll, said core being driven to maintain a tension force on said web and continuously wind said web from said web processing machine onto said core, locating a new core upstream of the wound roll with said new core being located beneath said web and closely adjacent to said web, applying a gripping means to engage the new core to define a frictional gripping force at the nip between said core and said gripping means, generating a slack loop in said web extending downwardly between said new core and said wound roll, said downwardly extended portion of said slack loop being drawn onto the adjacent surface of said new core by the rotation of said new core and wrapping the web about the new core and into the nip between said new core and said gripping means thereby exerting a force to pull the web from said wound roll into said nip and simultaneously exerting a force tending to wrap said web onto said new core with a sufficient force differential to establish separation of the web on a line essentially transverse to said web and thereby permitting the continued rotation of said new core and the continuous wrapping of said web onto said new core to initiate a new roll formation.

2. The method of claim 1 wherein said gripping means is a rotating roll means applied to the new roll.

3. The method of claim 1 including continued winding of the wound roll after said separation to complete the wrapping of the wound roll for removal and replacement with a new core.

4. In the apparatus of claim 1 including braking of said core of said wound roll essentially instantaneously to establish said differential force conjointly with the continued rotation of the new core at said rewind station.

5. A web transfer apparatus having a thin flexible web passed through at least one work station and rewound into a processed web roll, a winding station for receiving of said web, comprising a rotating first support means having means adapted to receive the free end of a web at said winding station for winding of the web upon itself into a roll, means to drive said support means for winding of the web into said roll, means to transfer said support means from said winding station with said web being maintained adjacent said winding station, means to locate a second support means at said winding station in operative engagement with the surface of said web, means to independently rotate said second support means, clamp means movable into engagement with the second support means, control means operable to simultaneously drive said second support means relative to said first support means and with said first and second support means rotating at different speeds whereby said web forms a slack loop between said first and second support means, means causing said slack web to move into the nip between said second support means and said clamp means and control means coupled to said first and second support means and including brake means for substantially reducing rotation of said first support means and thereby creating a rapid tension and snap action force on the slack web between said nip of said second support means and said clamp means resulting in a rapid and essentially continuous lateral separation of said web adjacent said clamp means for separation of said web and transfer of said web from said first support means to said second support means along any portion of said web present at the clamp means at the time of transfer.

6. The apparatus of claim 5 wherein said clamp means includes a rider means mounted adjacent said winding station and operable into engage the first or second support means in said winding station in spaced relation to the incoming position of said web and operable to engage the outer surface of said roll, said rider means being movably mounted to move outwardly as the diameter of the roll increases.

7. The apparatus of claim 6 including a second rider means coupled to said first or second support means and mounted to engage the roll on a core means during the movement from the winding station.

8. The apparatus of claim 5 wherein said means causing said slack web to move into said nip being said rotation of said second support means.

9. In a web processing apparatus for processing of an elongated web, a first rewind means adapted to receive said web to wrap saud web on itself to form a rewound roll of said web, a second rewind means adapted to receive said web and to wrap said web upon itself to form a rewound roll of said web, said first and second rewind means being movable with respect to each other and with respect to said processing apparatus, each of said rewind means being located and constructed whereby said web moves over the top side of each of said rewind means at least during the terminal portion of the winding of a web roll and during the initiation of the winding of said web roll, rider means operable to move into engagement with each of said rewind means at least during the initial winding of the web upon the corresponding rewind means to initiate formation of a roll and operable to form a firm frictional gripping of the web between the corresponding rewind means and the rider means, means to locate the second rewind means beneath said web and upstream of the first rewind means with the web passing over the second rewind means and being wound onto the first rewind means, drive control means coupled to said first rewind means and said second rewind means for controlling the rotational speed of the first and second rewind means and operable to provide a differential speed with said second rewind means rotating at a significantly higher speed than said first rewind means and thereby relieving the tension of the web immediately upstream of said first rewind means and forming a slack web between said first and second support means, said second rewind means being located immediately adjacent the underside of said web to operatively engage said slack web and cause the said web to move onto and about said second rewind means, said rider means operable to engage the slack web and tightly grip the web between said rotating second rewind means and said rider means as a double fold on said second rewind means, said control means driving said first rewind means and said second rewind means at said differential speed and including means to substantially reduce the rotation of said first rewind means to create a high tension force on said slack web between said first rewind means and said rider means and thereby establishing a snap action force on said web immediately adjacent said rider means resulting in a lateral severing of said web along any length position of said web located adjacent said rider means to thereby separate said web and effect an automatic transfer of the web from said first rewind means to said second rewind means.

10. The apparatus of claim 9 wherein said first rewind means and said second rewind means are mounted in spaced relation to a common support mechanism having means for simultaneously moving of said first and second rewind means, said support mechanism being constructed and arranged to alternate the operative position of said rewind means between said a final roll winding position and an initial winding position, whereby said web is transferred between said first and second rewind means in a continuous alternate sequence to form a series of said rewound web rolls, each of said rewind means being similarly constructed and including co-axial movable support means for releasably grasping of a tubular winding core adapted to form the rewind surface for receiving the free end of said web.

11. The rewind apparatus of claim 9 including a rewind turret support means having a substantially horizontal axis of rotation and including a plurality of similar radially outwardly extended support members, said support members being circumferentially spaced, means for securing said rewind means to the outer most end of each said turret support members, means to rotate said turret means to simultaneously locate one of said rewind means at a rewind station and the second rewind mens in circumferentially spaced relation at an unload/-load station, said support means located to locate said rewind means with said web in operative engagement with the surface of the rewind means moving into said rewinding station.

12. A paper web processing apparatus for coating or otherwise working a paper web without disturbing integrity of the web, comprising an unwind means operable to receive a web roll having many turns of web thereon and including splicing means for connection of the free end of a new roll to the trailing end of an unwinding roll to provide an essentially continuous supply of web into said apparatus, work stations within said apparatus through which said paper web moves for processing without distribution of said web, a rewind means including a rewind turret unit mounted adjacent the discharge side of said web processing apparatus, said turret unit having a shaft with a horizontal axis of rotation extending transversely across the web and having a pair of axially spaced rewind support arms extending diametrically from said shaft, chuck means secured to the outer ends of said arms for releasably receiving and supporting cylindrical rewind cores for receiving of and winding of said web into a roll, individual drive motors secured to the outer ends of one of said arms for individual driving of each of said cores, drive means for rotating of said turret shaft and thereby said turret arms between alternate horizontal positions including a winding station for selectively positioning the ends of said arms inwardly adjacent the processing apparatus for receiving of said web and a loading station outwardly of said processing apparatus for unloading of a wound roll and loading of a core in said chuck unit, a rider roll means located adjacent said winding station and pivotally mounted between a first position spaced from the path of the turret and pivotal from said first position to move into operative engagement with an unwound core in said winding station, said rider roll being adapted to establish frictional interengagement with said core, said turret unit including guide rollers located on diametrically opposite sides of said turret arms and spaced radially outwardly to define web guide rollers permitting wrapping of a web partially over the turret and onto a wound roll moving from said winding station, control means coupled to said drive motors for controlling the speed of said motors and thereby the speed of the core drive means, means feeding said web from said apparatus over the upper top side of said winding core at said winding station for wrapping of the web onto the core and forming a wound roll, said rider roll means moving outwardly of the core as the roll diameter increases, means for sensing the length of the web wound on said core at said rewind station and operable prior to receiving of final wraps of said web to actuate said turret drive motor and thereby rotate said turret to carry said winding roll from said winding station while continuing to wind web thereon, said guide roll serving to support said web and raise said web from said winding station as said turret rotates, said turret rotation causing said unwound new core to move to said winding station, means actuating said rider means to move into engagement with said new core as said turret unit rotates to said winding station, said web being positioned in overlying engaging position with said new core located at said winding station, said new core being operated essentially at winding speed at said winding location, means for sensing the relative rotational position of said turret arms and operable to decrease the winding speed of said wound roll while maintaining the speed of said new core whereby a slack loop is defined in said web between said new core and said wound roll, said high speed rotating new core developing an attraction for and grasping said adjacent web and drawing said web onto said core and into the nip between said new core and said rider means, and means for braking of said wound roll subsequent to the movement of said slack loop into said nip whereby a sudden snap action force is applied to the web between said rider means and said wound roll, said snap action force functioning to separate said web immediately adjacent said rider means in a line extending across said web and thereby freeing said web for a continuous winding onto said new core and defining a free web tail on the wound roll, and means to again actuate said drive means for the wound roll to thereby finish winding of the web tail onto said wound roll at said unloading station.

* * * * *

UNITED STATES PATENT AND TRADEMARK OFFICE

CERTIFICATE OF CORRECTION

PATENT NO. : 4,798,350

DATED : January 17, 1989

INVENTOR(S) : Allen R. Jorgensen, et al

It is certified that error appears in the above-identified patent and that said Letters Patent is hereby corrected as shown below:

Col. 10, line 29, delete "saud" and substitute therefor ---said---; Col. 10, line 64, after "cause" delete "the".

Signed and Sealed this

Twenty-fourth Day of October, 1989

*Attest:*

DONALD J. QUIGG

*Attesting Officer*

*Commissioner of Patents and Trademarks*